US011371779B2

(12) United States Patent
Demirci et al.

(10) Patent No.: US 11,371,779 B2
(45) Date of Patent: Jun. 28, 2022

(54) MELTING FURNACE WITH SIMULTANEOUSLY ROTATABLE AND MOVABLE ELECTRODE ROD

(71) Applicant: SMS group GmbH, Düsseldorf (DE)

(72) Inventors: Cihangir Demirci, Krefeld (DE); Ros El-Rabati, Bochum (DE); David Robinson, Sheffield (GB)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 16/762,066

(22) PCT Filed: Nov. 7, 2018

(86) PCT No.: PCT/EP2018/080389
§ 371 (c)(1),
(2) Date: May 6, 2020

(87) PCT Pub. No.: WO2019/091994
PCT Pub. Date: May 16, 2019

(65) Prior Publication Data

US 2020/0355435 A1 Nov. 12, 2020

(30) Foreign Application Priority Data

Nov. 8, 2017 (DE) ..... 10 2017 219 826.5

(51) Int. Cl.
*H05B 3/60* (2006.01)
*F27B 3/08* (2006.01)
(Continued)

(52) U.S. Cl.
CPC ..... *F27B 3/085* (2013.01); *B22D 23/10* (2013.01); *F27B 3/20* (2013.01); *F27D 11/10* (2013.01); *H01R 39/646* (2013.01); *H05B 7/10* (2013.01)

(58) Field of Classification Search
CPC .. F27D 11/08; F27D 11/10; F27B 3/08; F27B 3/085; F27B 3/10; F27B 3/183; F27B 3/19; F27B 3/20; F27B 3/24; F27B 3/28; H05B 7/005; H05B 7/02; H05B 7/07; H05B 7/10; H05B 7/101; H05B 7/102; H05B 7/109; H05B 7/148; H05B 7/152; H05B 7/18;
(Continued)

(56) References Cited

U.S. PATENT DOCUMENTS 3,220,067 A 11/1965 Hopkins
3,565,994 A * 2/1971 Jackson ..... C22B 9/18 373/50
(Continued)

FOREIGN PATENT DOCUMENTS

CN 201195738 2/2009
CN 201195738 Y * 2/2009
(Continued)

*Primary Examiner* — Hung D Nguyen
(74) *Attorney, Agent, or Firm* — Smartpat PLC

(57) ABSTRACT

Melting furnace (1), in particular for the production of metal alloys by melting alloying constituents, with a melting crucible (10), a cylindrical electrode rod (40) with a consumable electrode (41) attached thereto and a power supply (50) that is configured to supply the electrode (41) with power via the electrode rod (40), wherein the electrode rod (40) can be rotated about its own axis and moved along its own axis during the melting process.

18 Claims, 2 Drawing Sheets

(51) Int. Cl.

| | |
|---|---|
| ***B22D 23/10*** | (2006.01) |
| ***F27B 3/20*** | (2006.01) |
| ***F27D 11/10*** | (2006.01) |
| ***H01R 39/64*** | (2006.01) |
| ***H05B 7/10*** | (2006.01) |

(58) Field of Classification Search

CPC ..... H05B 7/20; B22D 23/10; H01R 39/26; H01R 39/30; H01R 39/38; H01R 39/381; H01R 39/383; H01R 39/385; H01R 39/40; H01R 39/42; H01R 39/64; H01R 39/646

USPC ..... 373/42, 44–54, 60, 67–73, 98–102

See application file for complete search history.

(56) References Cited

U.S. PATENT DOCUMENTS

| | | | | | |
|---|---|---|---|---|---|
| 3,806,745 | A | | 4/1974 | Verhoeven et al. | |
| 4,075,414 | A | * | 2/1978 | Thomas | C22B 9/18 373/105 |
| 4,154,973 | A | * | 5/1979 | Paton | C22B 9/18 373/51 |
| 4,185,158 | A | | 1/1980 | Koga et al. | |
| 4,433,229 | A | | 2/1984 | Morikawa et al. | |
| 4,641,319 | A | * | 2/1987 | Nagai | B22D 39/04 373/84 |
| 4,670,884 | A | | 6/1987 | Letizia et al. | |
| 4,742,528 | A | | 5/1988 | Stenzel | |
| 4,951,298 | A | | 8/1990 | Muller | |
| 4,993,690 | A | | 2/1991 | Stenzel et al. | |
| 5,260,966 | A | | 11/1993 | Schottlaender | |
| 5,274,662 | A | | 12/1993 | Krepel | |
| 5,810,904 | A | * | 9/1998 | Holzgruber | C22B 9/18 164/470 |
| 2003/0151328 | A1 | * | 8/2003 | Cutsforth | H01R 39/42 310/239 |
| 2016/0113073 | A1 | | 4/2016 | Popov et al. | |
| 2017/0331241 | A1 | * | 11/2017 | Ashimura | H01R 39/30 |

FOREIGN PATENT DOCUMENTS

| | | | | | |
|---|---|---|---|---|---|
| CN | 201381356 | | | 1/2010 | |
| CN | 201999975 | U | | 10/2011 | |
| CN | 105316488 | A | | 2/2016 | |
| CN | 107058755 | A | | 8/2017 | |
| CN | 206451960 | U | | 8/2017 | |
| DE | 1207967 | C2 | | 9/1993 | |
| DE | 19529924 | C1 | | 10/1996 | |
| DE | 19838683 | A1 | * | 3/2000 | A61C 13/20 |
| DE | 19838683 | A1 | | 3/2000 | |
| DE | 10156966 | A1 | | 4/2003 | |
| EP | 0094378 | A2 | | 11/1983 | |
| EP | 0183654 | A2 | | 6/1986 | |
| EP | 0212491 | A2 | | 3/1987 | |
| EP | 0378764 | A1 | | 7/1990 | |
| GB | 2264353 | A | | 8/1993 | |
| GB | 2559669 | A | | 8/2018 | |
| RU | 2486717 | C2 | | 6/2013 | |
| RU | 2598421 | C1 | | 9/2016 | |
| WO | 9015163 | A1 | | 12/1990 | |
| WO | 2013117529 | A1 | | 8/2013 | |
| WO | 2014177129 | A2 | | 11/2014 | |

* cited by examiner

MELTING FURNACE WITH SIMULTANEOUSLY ROTATABLE AND MOVABLE ELECTRODE ROD

TECHNICAL FIELD

The disclosure relates to a melting furnace, in particular for the production of metal alloys and non-ferrous alloys by melting alloying constituents.

BACKGROUND

Melting furnaces are used for the production of metal alloys by melting alloying constituents and, if necessary, additives. Melting furnaces are known in various designs. They are used both in the remelting of metal by means of an arc under vacuum and in so-called "electroslag remelting processes." The melting process is carried out by immersing an electrode in a melt and supplying it with a so-called "melting current." The melt acts as an electrical resistance, by which the melt is heated by the melt current.

The melting furnace usually has a melting crucible, which can be lined with cold or refractory materials, a furnace hood that closes the melting crucible, and an electrode rod that is immersed in the melting crucible through a vacuum-tight and/or gas-tight bushing in the furnace hood. The electrode rod, which carries the electrode, is connected to a high-current supply.

Since the electrode is gradually consumed—this is referred to as a "consumable electrode"—the electrode must be repositioned during operation. In order to be able to reposition the electrode rod with the electrode attached thereto, the unit usually has a height-adjustable electrode carriage or a drive system for holding and moving the electrode rod.

Melting furnaces of the type described above can be found, for example, in DE 42 07 967 A1, DE 101 56 966 A1, WO 2013/117529 A1 and WO 2014/177129 A2.

During the running process, it is necessary to reposition the electrode and precisely control the melting rate, in order to, for example, maintain a stable arc. However, not only the depth of immersion of the electrode in the melting crucible influences the melting process, but also the melting form, that is, the geometry and position of the electrode tip.

SUMMARY

One object of the disclosure is to provide an improved melting furnace, in particular for the production of metal alloys and non-ferrous alloys by melting alloying constituents.

The object is achieved with a melting furnace as claimed.

The melting furnace is a unit used for the production of metal alloys and non-ferrous alloys by electrically remelting an electrode, possibly under vacuum. For example, the melting furnace is designed as: Electroslag remelting unit (ESR) under inert gas or atmosphere with a stationary and/or sliding melting crucible; pressure electroslag remelting unit (PESR) under different inert gases or process gases with a stationary and/or sliding melting crucible; electroslag rapid remelting unit (ESRR) with a stationary and/or sliding melting crucible for the continuous production of electroslag-casted or electroslag remelted billets; vacuum arc remelting furnace (VAR); combination unit consisting of the aforementioned designs, in particular for an ESR unit with a stationary and/or sliding melting crucible along with an electron beam furnace (EB). It should be noted that the term "melting furnace" does not refer to the "furnace" or melting crucible in the strict sense, but to the melting unit as a whole.

The melting furnace has a melting crucible, which is preferably lined with cold or refractory materials. The melting crucible, for example a hollow cylindrical vessel that is closed at the bottom, is designed for melting alloying constituents, additives, etc. The melting furnace further has an electrode rod with a consumable electrode attached thereto and a power supply that is configured to supply power to the electrode via the electrode rod, such that melting energy can be introduced into the molten metal in the melting crucible, also called molten pool, sump or metal sump; for example, an electric arc is ignitable between the electrode and the molten metal. During the melting process, the electrode rod can be rotated about its own axis and moved along its own axis.

The rotatability and movability of the electrode rod during the melting process allows the precise repositioning and adjustment of the electrode, which improves the stability of the melting process. In this case, the movability is provided in particular along the axial direction of the electrode rod, that is, usually in the direction of gravity. In particular, any uneven melting of the electrode tip can be compensated for by a combination of rotation and raising/lowering the electrode.

The movability of the electrode rod preferably enables an oscillating movement in order to be able to adjust the electrode rod in an oscillating manner, according to the electrode consumption. The oscillation of the electrode keeps the electrode tip in the slag bath constantly within a defined range; in particular, the distance between the electrode tip in the slag bath and the surface of the same is kept constant.

Preferably, the electrode rod is attached to an electrode carriage via an electrode receptacle, which is held on a furnace column and is guided for movability. The furnace column, for example as part of a frame of the melting furnace, allows the modular mounting and guidance of movable components of the melting furnace.

Preferably, the electrode carriage can be moved by means of a spindle drive or hydraulic cylinder, wherein the spindle drive is attached to the electrode carriage particularly preferably, and has one or more motor-driven, for example electromotive-driven, spindle nuts that interact with a spindle that runs essentially parallel to the furnace column. In this manner, the vertical movability of the electrode can be achieved in a structurally simple and reliable as well as modular manner.

Preferably, the melting furnace has a motor-driven, for example electromotive-driven, rotary drive for rotating the electrode rod about its axis, wherein the rotary drive is preferably attached to the electrode receptacle. In this manner, the rotatability of the electrode can be achieved in a structurally simple and reliable as well as modular manner. In addition, the simultaneous rotation and movement of the electrode during the melting process is ensured.

Preferably, the electrode rod is electrically connected to the power supply via a current collector, wherein the current collector has one or more contacting devices that are configured to transfer the current provided by the power supply to the electrode rod. The current collector can be structured to be compatible with different formats of the electrode rod. The current collector can have bushings to accommodate power supply lines and/or to protect against damage and dirt. The current collector ensures a reliable connection of the electrode to the power supply, even during any rotation and/or movement of the electrode rod. The current collector can be a separate component or, for example, part of the electrode rod.

The contacting device (by analogy, several contacting devices) can be constructed in different ways, and can also consist of different conductive and non-conductive materials, as long as a safe contact with the rotatable and movable electrode rod is ensured. For example, the contacting device can have a receptacle that is in electrically connected with the electrode rod and contains a conductive liquid, preferably liquid gallium, in which a current output, which is in electrical communication with the power supply, is immersed. Alternatively or additionally, the contacting device can have one or more brushes, preferably made of a graphite-containing and/or copper-containing material, which are in frictional contact with the electrode rod. Alternatively or additionally, the contacting device can have at least one shell element, preferably made of a graphite-containing and/or copper-containing material, which is in frictional contact with the electrode rod. The shell element can be designed as a ring or a ring segment.

Preferably, the melting furnace has a movable furnace hood that is configured to close the melting crucible, wherein the electrode rod and/or the electrode is immersed in the melting crucible through a preferably vacuum-tight and gas-tight bushing in the furnace hood. The furnace hood is preferably compatible for different melting crucible dimensions. Despite the preferred vacuum and gas tightness, the furnace hood allows the electrode rod to move vertically relative to the melting crucible. In accordance with a preferred embodiment, the furnace hood is attached to and guided by the furnace column via a hood carriage. The height adjustment of the furnace hood can be carried out by means of a spindle drive, for example. Preferably, however, the furnace hood is instead attached to the electrode carriage by means of a hydraulic cylinder or a spindle drive, by which a relative distance between them can be adjusted in a hydraulic manner.

Preferably, the melting crucible is attached via a furnace platform to a platform carriage that is held on the furnace column and is guided for movability. This allows the melting crucible to be attached to the furnace column in a modular manner.

Preferably, the platform carriage can be moved by means of a platform spindle drive, wherein the platform spindle drive is preferably attached to the platform carriage and has one or more motor-driven spindle nuts that interact with a platform spindle that runs essentially parallel to the furnace column. In this manner, the vertical movability of the melting crucible can be achieved in a structurally simple and reliable as well as modular manner.

Preferably, the melting furnace has one or more weighing cells, which are measuring cells for weighing the weight of the electrode and/or the (re)melted ingot or molten pool in the melting crucible. Preferably, the weighing cells are installed below the base plate of the melting crucible and/or on the electrode carriage and/or on the platform carriage, in particular preferably below the melting crucible. Usually, weighing cells are installed at the head of the melting crucible with associated mounting plates. In such a case, the measured weight values can be falsified by the rotational operation of the electrode. The installation of the weighing cells below the base plate of the melting crucible, if necessary alternatively or additionally on the electrode carriage and/or on the platform carriage, can improve the measuring accuracy in a melting furnace with a rotating electrode.

Although the melting furnace is used particularly preferably in the technical environment of the production of metal alloys, the melting furnace can also be implemented in other fields, in particular when a consumable electrode is used by electrically igniting and maintaining an arc between the electrode and a melt. The electrochemical melting of aluminum, silicon and calcium carbide should be mentioned in particular. The invention is also suitable for the production of metal powder for 3D printers.

Further advantages and features of the present melting furnace can be seen from the following description of preferred exemplary embodiments. The features described therein may be implemented on their own or in combination with one or more of the features set out above, provided that the features are not contradictory. The following description of the preferred exemplary embodiments is given with reference to the accompanying drawings.

DETAILED DESCRIPTION

In the following, preferred exemplary embodiments are described on the basis of the figures. Thereby, identical, similar or equally effective elements in the figures are marked with identical reference signs, and a repeated description of such elements is sometimes omitted in order to avoid redundancies.

Figure 1:
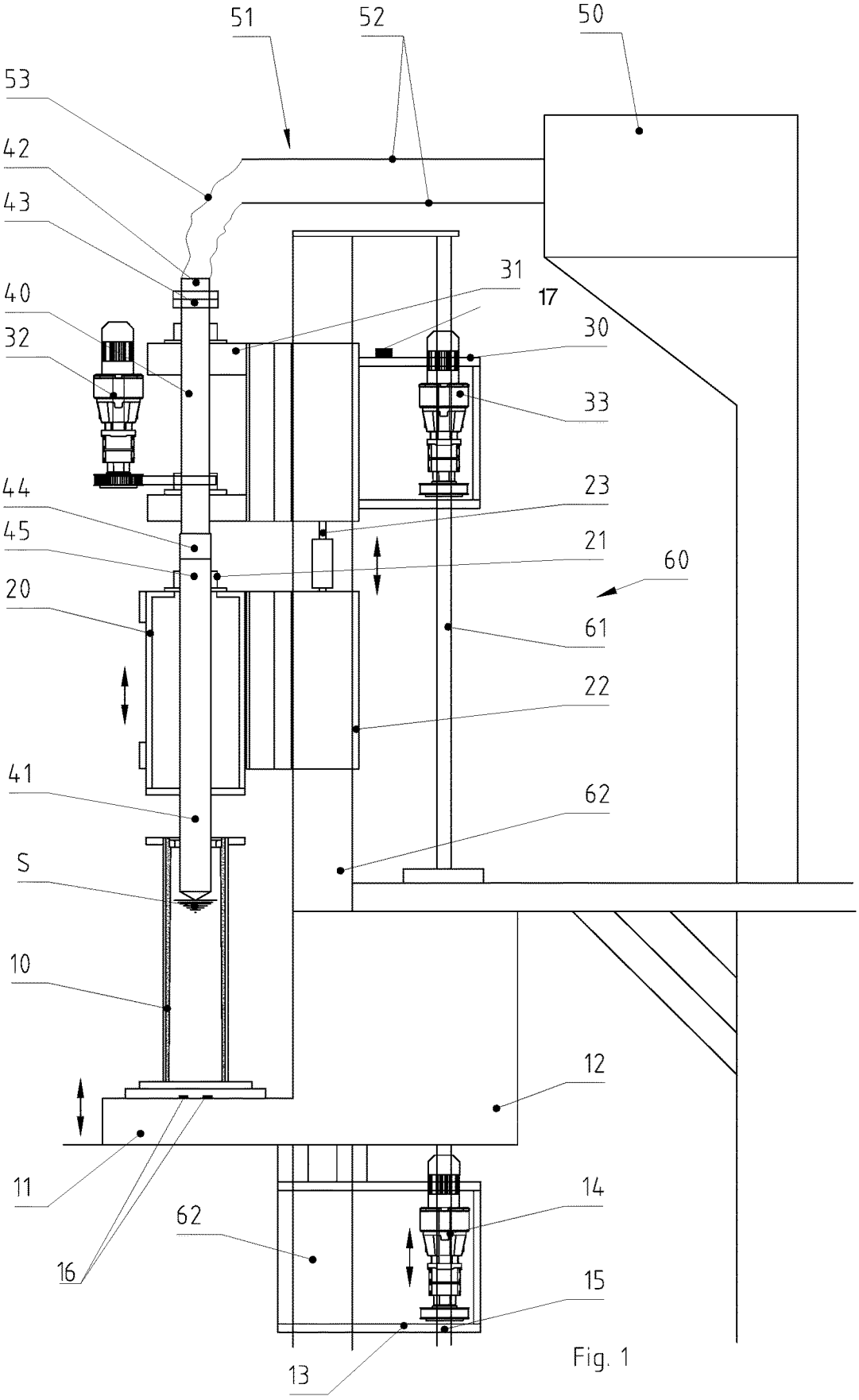
FIG. 1 shows a melting furnace with a melting crucible and a rotatable and movable electrode rod.

FIG. 1 shows a melting furnace 1, which is used to produce metal alloys by electrically remelting an electrode, possibly under vacuum. For example, the melting furnace 1 is designed as: electroslag remelting unit (ESR) with a stationary and/or sliding melting crucible; pressure electroslag remelting unit (PESR) with a stationary and/or sliding melting crucible; electroslag rapid remelting unit (ESRR) with a stationary and/or sliding melting crucible for the continuous production of electroslag-casted or electroslag remelted billets; vacuum arc remelting furnace (VAR); combination unit consisting of the aforementioned designs, in particular for an ESR unit with a stationary and/or sliding melting crucible along with an electron beam furnace (EB).

The melting furnace 1 has a melting crucible 10, which is preferably lined with cold or refractory materials. The melting crucible 10 is a hollow cylindrical vessel that is closed at the bottom and is designed for melting alloying constituents, additives, etc. The melting furnace 1 also has a furnace hood 20, which is configured to close the melting crucible 10. Preferably, the furnace hood 20 is compatible for different melting crucible dimensions. In addition, the furnace hood 20 preferably has a cooling system, such as a water cooling system.

Above the furnace hood 20, a height-adjustable electrode carriage 30 is provided for holding, pivoting, rotating and moving an electrode rod 40. For this purpose, the electrode carriage 30 has an electrode receptacle 31, which rotatably supports the electrode rod 40. The electrode carriage 30 can also have a rotary drive 32 for rotating or turning the electrode rod 40 about its axis. The rotary drive 32 can, for example, be attached to the electrode receptacle 31 or integrated with it, such that a height adjustment of the electrode carriage 30 together with the electrode rod 40 is ensured, while the electrode rod 40 rotates at the same time.

The electrode rod 40 carries or holds a consumable electrode 41, also known as a "consumable electrode."

With the furnace hood 20 on, and the electrode carriage 30 and electrode rod 40 in the mounted state, the electrode rod 40 and/or electrode 41 is immersed in the melting crucible 10 through a vacuum-tight and gas-tight bushing 21 in the furnace hood 20. The melting energy inside the melting crucible 10 is generated, for example, by an arc burning between the tip of electrode 41 and the surface of the molten pool S (also designated as a "sump" or "metal sump"). In order to maintain a stable arc, the distance between the electrode tip and the surface of the molten pool S must be kept constant within a defined range.

To apply a melting current to electrode 41, it is connected via power supply lines 51 to a power supply 50, which is preferably a high-current supply. The power supply lines 51 can be implemented by busbars 52 connected to flexible power strips or power cables 53, by flexible power cables 53 alone, or in some other manner, in order to ensure a reliable power supply, despite the adjustability of the electrode carriage 30. The power supply lines 51 are connected to contacting devices 43 of a current collector 42. The current collector 42 is part of the electrode rod 40 or is connected to it, in order to transfer the current provided by the power supply 50 via the contacting devices 43 to the rotatable and movable electrode rod 40. Thereby, the current collector 42 can be structured to be compatible with different formats of the electrode rods 40. The current collector 42 can have bushings to accommodate the power supply lines 51 and/or to protect against damage and dirt. The current collector 42, via which the current is transferred to the electrode rod 40, is preferably water-cooled or air-cooled.

In accordance with the embodiment of FIG. 1, a coupling 44 is provided between the electrode rod 40 and a stub 45, by which a circuit for supplying the electrode 41 and a support of the electrode 41 will be set up, such that an arc can be ignited in the melting crucible 10 between the electrode 41 and the melt, or melt energy can be introduced into the melt, and this can be kept constant over the entire melting time under vacuum, inert gas or atmosphere with the height-adjustable electrode carriage 30.

With units operated under vacuum, such as VAR or EB furnaces, the melting energy is generated by the arc burning between the tip of the electrode 41 and the surface of the molten pool S in the melting crucible 10. In order to maintain a stable arc, the distance between the electrode tip and the surface of the molten pool S must be kept constant. This is done by means of a control not shown, which can be computer-supported and algorithmic, for example. With units operating under inert gas or atmosphere, such as ESR or inert gas ESR units, the melting energy is converted into Joule heat by converting the electrical energy with the resistance of the slag.

For the repositioning, adjustment and oscillation of the electrode rod 30, the furnace 1 has the aforementioned height-adjustable electrode carriage 30 for holding the electrode rod 40. Thereby, the electrode rod 30 can be moved along the axial direction of the electrode rod 40, that is, in the up/down direction in accordance with FIG. 1. The electrode rod 40 is preferably repositioned in an oscillating manner according to the electrode consumption. The oscillation of the electrode 41 keeps the electrode tip in the slag bath constantly within a defined range; in particular, the distance between the electrode tip in the slag bath and the surface of the same is kept constant. The movability is preferably realized by a spindle drive 33, which is part of the electrode carriage 30 or is rigidly connected to it. The spindle drive 33 interacts with a spindle 61 of a frame 60, which carries components of the melting furnace 1, in particular the electrode carriage 30, the furnace hood 20 and the melting crucible 10. For example, the spindle drive 33 can have one or more motor-driven spindle nuts that engage in a thread of spindle 61, in order to adjust the height of the electrode carriage 30 by turning the spindle nuts.

Figure 2A:
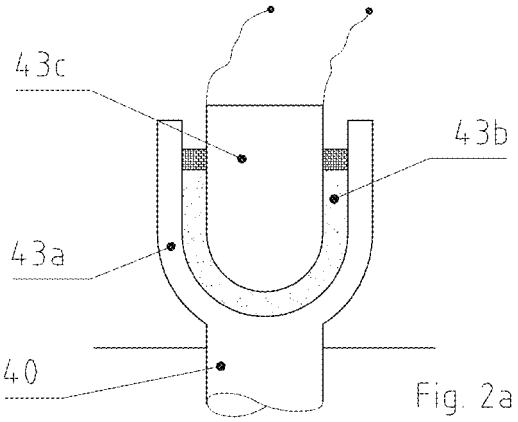
FIGS. 2*a* to 2*c* show exemplary embodiments of contacting devices for the current-conducting connection of the rotatable and movable electrode rod with a power supply.
Figure 2B:
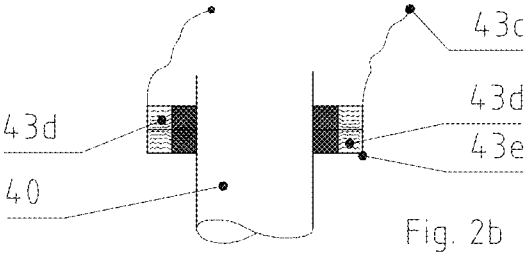
Figure 2C:
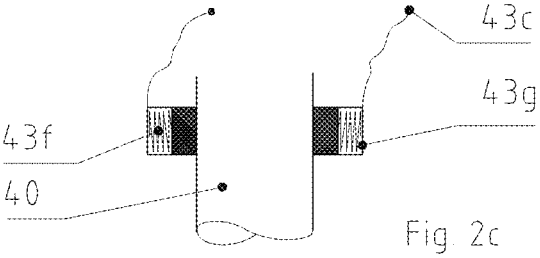

The contacting devices 43 can be structured in different ways and can also consist of different conductive and non-conductive materials, as long as a safe contact with the rotatable electrode rod 40 is ensured. For example, FIG. 2*a* shows a receptacle 43*a* in which liquid gallium 43*b* is introduced. A current output 43*c*, which is connected to the power supply 50 via the power supply lines 51, is also immersed in the liquid gallium. Other current-conducting liquids can also be used as liquid current transfer medium. FIG. 2*b* shows an additional example of a current transmission structure using brushes 43*d*, for example those made of a material containing graphite and/or copper (such as graphite, hard graphite, carbon, carbon fiber, copper, copper alloy, etc.), which, connected to a receptacle 43*e*, are in frictional contact with the electrode rod 40. FIG. 2*c* shows an additional structure that uses a shell element 43*f* instead of the brushes 43*d*, which is held in a receptacle 43*g* and is in frictional contact with the electrode rod 40. The shell element 43*f* can be made in one piece or in several parts; for example, it can be made of a material containing graphite. Furthermore, the shell element 43*f* can be pressed against the electrode rod 40 by means of elastic elements, such as springs, in order to ensure secure contact.

In addition to being rotatable about its own axis and movable vertically along its own axis (corresponding to the axis of the furnace column 62 described below), the electrode rod 40 can also be mounted so that it can move along or about other axes, in order to improve adjustability and thus stability during melting. Furthermore, the current collector 42 can be configured to be adjustable, in order to fit the electrode rod 40. For this purpose, the current collector 42 can have one or more media connections that are supplied and controlled by corresponding control points.

In order to simplify the power supply via the current collector 42, the interaction between it and the electrode rod 40 can be modularized. For example, the contacting devices 43 can be attached to the current collector 42 by means of fixing devices and can engage in or be accommodated in corresponding fixing receptacles on the electrode rod 40, as shown in the examples of the embodiments in FIGS. 2*a* to 2*c*. In this manner, the current collector 42 can be reliably connected to electrode 41 as a consumer. The electrode rod 40 can be divided by the aforementioned coupling 44 (or the electrode 41 can be connected to the electrode rod 40 via the coupling 44), in order to make it easier to change the electrode 41, in particular to replace a used electrode 41 with a new electrode 41. The coupling can be operated hydraulically or pneumatically.

The frame 60 can have a furnace column 62, on which the electrode carriage 30 and/or the furnace hood 20 are guided and held. In addition, additional components, such as the spindle drive 33, can be guided and held on the furnace column 62, in order to achieve a modular structure of the melting furnace 1. Thus, in accordance with the present embodiment, the melting crucible 10 is guided and held by a furnace platform 11 and a platform carriage 12, also on the furnace column 62. While the furnace platform 11 is fixed with a stationary melting crucible unit, in accordance with the embodiment shown in FIG. 1 (sliding melting crucible unit), the melting crucible 10 is height-adjustable in this manner. For this purpose, the furnace platform 11 can be attached to the furnace column 62 in a movable manner via a guide 13 and/or the platform carriage 12. The movability can be realized by a platform spindle drive 14, which interacts with a platform spindle 15. For example, the platform spindle drive 14 can have one or more motor-driven spindle nuts, which engage in a thread of the platform spindle 15, in order to adjust the height of the melting crucible 10 by turning the spindle nuts. Thus, the melting crucible 10 can be lowered and/or raised according to the filling rate of the melting crucible 10 and/or the electrode melting rate. In addition to movability along the axis of the furnace column 62, the melting crucible 10 can also be mounted so that it can be moved along other axes, in order to improve adjustability and thus stability during melting. For example, the adjustment along axes that are perpendicular to the axis of the furnace column 62 can be realized by means that are integrated below the base plate of the melting crucible 10, for example in the furnace platform 11.

The vacuum-tight bushing 21 of the furnace hood 20 ensures the vertical movement of the electrode rod 40 through the center of the furnace hood 20, which, in accordance with the present embodiment, is attached and guided to the furnace column 62 by a hood carriage 22. The height adjustment can also be carried out by means of a spindle drive, or also, as shown in FIG. 1, for example, by means of one or more hydraulic cylinders 23, which are attached on one side to the hood carriage 22 and on the other side to the electrode carriage 40, and are configured to set a relative distance between them.

Figure 3A:
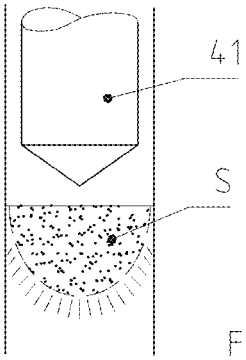
FIGS. 3*a* and 3*b* show shapes of the electrode tip and the metal sump located below it.
Figure 3B:
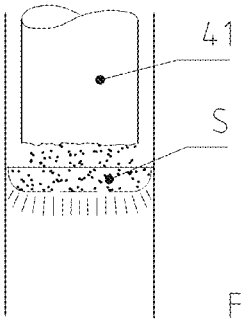

The rotatable and vertically movable electrode rod 40 makes it possible to change the front surface of the electrode 41 from a conventional V-shape, see FIG. 3*a*, to a flat U-shape, see FIG. 3*b*. Thus, the shape of the metal sump S located under electrode 41 is preferably also changed from the V-shape to a flat U-shape.

Preferably, the furnace 1 has one or more weighing cells (16, 17), which are measuring cells for weighing the weight of the electrode 41 and/or the (re)melted ingot or molten pool S in the melting crucible 10. Preferably the weighing cells (16, 17) are installed below the base plate of the melting crucible 10 and/or on the electrode carriage 30 and/or on the platform carriage 12, particularly preferably below the melting crucible 10. In this manner, the measuring accuracy can be improved for a melting furnace 1 with a rotating electrode.

To the extent applicable, all individual features shown in the exemplary embodiments can be combined and/or exchanged without leaving the field of the invention.

LIST OF REFERENCE SIGNS

1 Melting furnace
10 Melting crucible
11 Furnace platform
12 Platform carriage
13 Guide
14 Platform spindle drive
15 Platform spindle
16 Weighing cells installed on the platform carriage below a base plate of the melting crucible
17 Weighing cells installed on the electrode carriage
20 Furnace hood
21 Bushing
22 Hood carriage
23 Hydraulic cylinder
30 Electrode carriage
31 Electrode receptacle
32 Rotary drive
33 Spindle drive
40 Electrode rod
41 Electrode
42 Current collector
43 Contacting device
43*a* Receptacle
43*b* Liquid gallium
43*c* Current output
43*d* Brush
43*e* Receptacle
43*f* Shell element
43*g* Receptacle
44 Coupling
45 Stub
50 Power supply
51 Power
52 Busbar
53 Current strip
60 Frame
61 Spindle
62 Furnace column
S Metal sump/molten pool

The invention claimed is:

1. A melting furnace (1), in particular for producing metal alloys and non-ferrous alloys, comprising:
an electrode rod (40) with a consumable electrode (41) attached thereto, the consumable electrode comprising alloying constituents to be remelted;
a melting crucible (10); and
a power supply (50) that is configured to supply the consumable electrode (41) with power via the electrode rod (40),
wherein the electrode rod (40) is rotatable about a longitudinal axis and can be moved along the longitudinal axis during a melting process and
wherein a remelted ingot comprising the alloying constituents is formed in the melting crucible during the melting process, and
wherein the melting furnace (1) is configured to simultaneously rotate the electrode rod (40) about the longitudinal axis and oscillate the electrode rod (40) along the longitudinal axis during the melting process.

2. The melting furnace (1) according to claim 1,
wherein the electrode rod (40) is attached via an electrode receptacle (31) to an electrode carriage (30), and
wherein the electrode carriage (30) is held on and movably guided by a furnace column (62).

3. The melting furnace (1) according to claim 2,
wherein the electrode carriage (30) is movable by means of a spindle drive (33),
wherein the spindle drive (33) is fixed to the electrode carriage (30) and has one or more motor-driven spindle nuts that interact with a spindle (61) that runs substantially parallel to the furnace column (62).

4. The melting furnace (1) according to claim 2, further comprising a motorized rotary drive (32) for rotating the electrode rod (40) about the longitudinal axis, the rotary drive (32) being mounted on the electrode receptacle (31).

5. The melting furnace (1) according to claim 1,
wherein the electrode rod (40) is electrically connected to the power supply (50) via a current collector (42), and wherein the current collector (42) has one or more contacting devices (43), which are configured to transfer the current provided by the power supply (50) to the electrode rod (40).

6. The melting furnace (1) according to claim 5, wherein the one or more contacting devices include a receptacle (43*a*) that is electrically connected to the electrode rod (40) and contains a conductive liquid (43*b*) in which a current output that is electrically connected to the power supply (50) is immersed; and/or one or more brushes (43*d*) which are in frictional contact with the electrode rod (40); and/or a shell element (43*f*) which is in frictional contact with the electrode rod (40).

7. The melting furnace (1) according to claim 5, wherein the conductive liquid (43*b*) is liquid gallium.

8. The melting furnace (1) according to claim 5, wherein the one or more contacting devices include one or more brushes (43*d*) which are in frictional contact with the electrode rod (40) and wherein the one or more brushes (43*d*) are made of a graphite-containing and/or copper-containing material.

9. The melting furnace (1) according to claim 5, wherein the one or more contacting devices include a shell element (43*f*) which is in frictional contact with the electrode rod (40) and wherein the shell element (43*f*) is made of a graphite-containing and/or copper-containing material.

10. The melting furnace (1) according to claim 1, further comprising a movable furnace hood (20), which is configured to close the melting crucible (10), wherein the electrode rod (40) and/or the consumable electrode (41) is immersed in the melting crucible (10) through a bushing (21) in the furnace hood (20).

11. The melting furnace (1) according to claim 10, wherein the bushing (21) is vacuum-tight and gas-tight.

12. A melting furnace (1), for producing metal alloys and non-ferrous alloys by melting alloying constituents, comprising:

a furnace column (62);

a melting crucible (10);

a furnace hood (20) which is configured to close the melting crucible (10), the furnace hood (20) being held on movably guided by the furnace column (62);

an electrode carriage (30) held on and movably guided by the furnace column (62);

an electrode receptacle (31) attached to the electrode carriage (30);

an electrode rod (40) with a consumable electrode (41) attached to the electrode receptacle (31); and a power supply (50) that is configured to supply the consumable electrode (41) with power via the electrode rod (40), wherein the electrode rod (40) is rotatable about a longitudinal axis and can be moved along the longitudinal axis during a melting process, and wherein the consumable electrode (41) is immersed in the melting crucible (10) through a bushing (21) in the furnace hood (20), and wherein the furnace hood (20) is attached to the electrode carriage (30) by a hydraulic cylinder (23), the hydraulic cylinder (23) being configured to adjust a relative distance between the furnace hood (20) and the electrode carriage (30).

13. The melting furnace (1) according to claim 12, wherein the melting crucible (10) is attached via a furnace platform (11) to a platform carriage (12), the platform carriage (12) being held on and movably guided by the furnace column (62).

14. The melting furnace (1) according to claim 13, wherein the platform carriage (12) is movable by a platform spindle drive (14), wherein the platform spindle drive (14) is fixed to the platform carriage (12) and has one or more motor-driven spindle nuts that interact with a platform spindle (15) that runs substantially parallel to the furnace column (62).

15. The melting furnace (1) according to claim 13, further comprising at least one weighing cell which is installed on the platform carriage (12).

16. The melting furnace (1) according to claim 12, further comprising one or more weighing cells for weighing a weight of the consumable electrode (41) and/or the melting crucible (10).

17. The melting furnace (1) according to claim 16, wherein at least one of the one or more weighing cells is installed below a base plate of the melting crucible (10).

18. The melting furnace (1) according to claim 16, wherein at least one of the one or more weighing cells is installed on the electrode carriage (30).

* * * * *